United States Patent [19]

Chamberlin, III

[11] 4,326,972

[45] Apr. 27, 1982

[54] CONCENTRATES, LUBRICANT COMPOSITIONS AND METHODS FOR IMPROVING FUEL ECONOMY OF INTERNAL COMBUSTION ENGINE

[75] Inventor: William B. Chamberlin, III, Kirtland, Ohio

[73] Assignee: The Lubrizol Corporation, Wickliffe, Ohio

[21] Appl. No.: 915,486

[22] Filed: Jun. 14, 1978

[51] Int. Cl.[2] ..... C10M 1/40

[52] U.S. Cl. ..... 252/33.3; 184/1 E; 252/33.4; 252/32.7 R

[58] Field of Search ..... 252/33.3

[56] References Cited

U.S. PATENT DOCUMENTS 3,272,746 9/1966 Le Suer et al. ..... 252/47.5
3,312,618 4/1967 Le Suer et al. ..... 252/33
3,702,300 11/1972 Coleman ..... 252/51.5 A
3,926,822 12/1975 Habiby ..... 252/48.6

FOREIGN PATENT DOCUMENTS 1432277 4/1976 United Kingdom .
1481553 8/1977 United Kingdom .

*Primary Examiner*—Paul F. Shaver
*Attorney, Agent, or Firm*—William H. Pittman; Ronald L. Lyons; John P. Ward

[57] ABSTRACT

Fuel economy of internal combustion engines, especially gasoline engines, is improved by lubricating such engines with specific lubricant compositions in which the essential ingredients are a specific sulfurized composition and a basic alkali metal sulfonate. Additional ingredients may include at least one oil-dispersible detergent or dispersant, a viscosity improving agent, and a specific salt of a phosphorus acid.

52 Claims, No Drawings

CONCENTRATES, LUBRICANT COMPOSITIONS AND METHODS FOR IMPROVING FUEL ECONOMY OF INTERNAL COMBUSTION ENGINE

INTRODUCTION AND STATEMENT OF THE INVENTION

This invention relates to compositions and methods for improving the operation of internal combustion engines, specifically by reducing fuel consumption thereof. More particularly, the invention comprises lubricating compositions which may be used in such engines to decrease fuel consumption, and a method of using such lubricating compositions to accomplish this purpose.

In view of the petroleum shortage a few years ago, the increasing cost of petroleum products and the desire for conservation of natural resources such as petroleum, fuel economy is an important factor in designing engines and materials for use therein. It is readily recognized that a situation under which fuel consumption is minimized is desirable, both because of the conservation factor and because such a situation is economical for the user of the engine.

Accordingly, a principal object of the present invention is to provide lubricating compositions which, when used in internal combustion engines, minimize fuel consumption thereby, and additive concentrates useful in preparing such lubricating compositions.

A further object is to provide methods for reducing fuel consumption in internal combustion engines.

Another object is to provide compositions and methods for reducing gasoline consumption in automotive engines and the like.

Other objects will in part be obvious and will in part appear hereinafter.

In its broadest sense, the present invention comprises lubricating compositions and a method of reducing fuel consumption by lubricating an engine during operation therewith, said compositions comprising:

(A) A lubricating oil;

(B) a composition prepared by sulfurizing, at a temperature of about 100° to about 250° C., a mixture comprising (B-1) 100 parts by weight of at least one ester of a substantially aliphatic carboxylic acid containing from about 8 to about 30 carbon atoms and a substantially aliphatic alcohol, (B-2) from about 2 to about 50 parts of at least one substantially aliphatic carboxylic acid containing from about 8 to about 30 carbon atoms, and (B-3) from about 25 to about 400 parts by weight of at least one substantially aliphatic monoolefin containing from about 8 to about 36 carbon atoms; and (C) at least one oil-dispersible basic alkali metal sulfonate.

In a still more specific sense, the invention includes compositions (and methods for their use) additionally comprising one or more of the following:

(D) At least one oil-dispersible detergent or dispersant, with the proviso that if it is a detergent it is not a basic alkali metal salt;

(E) at least one viscosity improving component;

(F) at least one compound of the formula

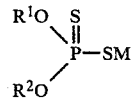

wherein each of $R^1$ and $R^2$ is a hydrocarbon-based radical having from about 3 to about 20 carbon atoms and M is a Group I metal, a Group II metal, aluminum, tin, iron, cobalt, lead, arsenic, molybdenum, manganese, nickel, or a mixture of any of said metals.

Each of components D, E and F is optional in the sense that its presence is not essential for the purposes of this invention, but is preferred because of the superior results as regards fuel economy and other desirable properties when such materials are present. The listing of several such materials in the alternative is not intended to imply that all such alternative materials are equivalent for the purposes of this invention; some may be preferred over others as frequently noted hereinafter.

COMPONENT A—THE LUBRICATING OIL

An essential component of the compositions of this invention is a lubricating oil. It is ordinarily present in major amounts, although it may be present in minor amounts in certain additive concentrates described hereinafter. Suitable lubricating oils include natural and synthetic oils and mixtures thereof. These include principally crankcase lubricating oils for spark-ignited and compression-ignited internal combustion engines, including automobile and truck engines, marine and railroad diesel engines and the like. They can also be used in gas engines, stationary power engines and turbines and the like.

Natural oils include animal oils and vegetable oils (e.g., castor oil, lard oil) as well as liquid petroleum oils and solvent-treated or acid-treated mineral lubricating oils of the paraffinic, naphthenic or mixed parafinic-naphthenic types. The mineral oils are preferred. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based materials such as the polyalkyl-, polyaryl-, polyalkoxy-, or polyaryloxy-siloxanes and silicates comprise another useful class of synthetic oils; these include tetraethyl silicate, tetraisopropyl silicate, tetra(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)siloxanes, poly(methylphenyl)siloxanes, etc. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used as component A in accordance with this invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

COMPONENT B—THE SULFURIZED COMPOSITION

The second essential component of the lubricating compositions of this invention is a composition prepared by sulfurizing a mixture comprising three essential reagents. Reagent B-1 is at least one ester of a substantially aliphatic carboxylic acid containing from about 8 to about 30 carbon atoms and a substantially aliphatic alcohol. By "substantially aliphatic" is meant an organic compound in which a predominant number of carbon atoms is aliphatic; that is, is present in a chain rather than in an alicyclic or aromatic ring. The preferred acids and alcohols are those in which all carbon atoms are aliphatic, but the invention also contemplates acids and alcohols containing aromatic or alicyclic substituents (e.g., phenyl, chlorophenyl, nitrophenyl, cyclohexyl) on the aliphatic chain. The carboxylic acid and alcohol are ordinarily free from acetylenic unsaturation. Suitable acids include (preferably) monocarboxylic acids such as octanoic, nonanoic, decanoic, lauric, myristic, palmitic, stearic, eicosanoic, triacontanoic, oleic, linoleic, linolenic and ricinoleic acids, as well as polycarboxylic acids such as the product obtained by alkylating maleic or fumaric acid with a $C_{15-18}$ $\alpha$-olefin mixture. Suitable alcohols include monohydric and polyhydric alcohols usually containing from about 1 to about 15 carbon atoms such as methanol, ethanol, 1-propanol, 2-propanol, the butanols, the octanols, the decanols, the dodecanols, ethylene glycol, propylene glycol, trimethylene glycol, glycerol, pentaerythritol, diethylene glycol, triethylene glycol and dipentaerythritol.

The preferred esters are those in which the acid is a fatty acid and the alcohol is an alkanol or an alkanediol containing from about 1 to about 4 carbon atoms. By "fatty acid" is meant an acid which may be obtained by hydrolysis of a naturally occurring vegetable or animal fat or oil. These are usually in the $C_{16-20}$ range and include palmitic acid, stearic acid, oleic acid, linoleic acid and the like. Most desirable are esters in which the acid moieties contain olefinic unsaturation (e.g., oleic and linoleic acids), and especially those in which the predominant unsaturated acid moiety is oleic. The preferred alcohols include methanol, ethanol, the propanols, the butanols, ethylene glycol and glycerol, the latter being especially desirable.

Thus, it will be appreciated that reagent B-1 is most preferably at least one fatty oil; that is, at least one naturally occurring ester of glycerol and a fatty acid, or a synthetic ester of similar structure. Such naturally occurring animal and vegetable oils as lard oil, peanut oil, cottonseed oil, soybean oil and corn oil are among the especially preferred fatty oils.

Reagent B-2 is at least one substantially aliphatic carboxylic acid containing from about 8 to about 30 carbon atoms. The acids listed hereinabove with respect to reagent B-1 may be used as reagent B-2, and the same preferences apply. In particular, reagent B-2 may be an unsaturated fatty acid such as oleic or linoleic acid, and may be a mixture of acids such as is obtained from tall oil or by the hydrolysis of peanut oil, soybean oil or the like. The amount of reagent B-2 used in about 2–50 parts by weight per 100 parts of reagent B-1; about 2–8 parts by weight is preferred.

Reagent B-3 is at least one substantially aliphatic monoolefin containing from about 8 to about 36 carbon atoms, and is present in the amount of about 25–400 parts by weight per 100 parts of reagent B-1. Suitable olefins include the octenes, decenes, dodecenes, eicosenes and triacontenes, as well as analogous compounds containing aromatic or non-hydrocarbon substituents which are substantially inert in the context of this invention. (As used in the specification and appended claims, the term "substantially inert" when used to refer to solvents, diluents, substituents and the like is intended to mean that the solvent, diluent, substituent, etc. is inert to chemical or physical change under the conditions in which it is used so as not to materially interfere in an adverse manner with the preparation, storage, blending and/or functioning of the composition, additive, compound, etc. in the context of its intended use. For example, small amounts of a solvent, diluent, substituent, etc., can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.) Terminal olefins, or α-olefins, are preferred, especially those containing from about 12 to about 20 carbon atoms. Especially preferred are straight chain α-olefins. Mixtures of these olefins are commercially available and such mixtures are contemplated for use in this invention.

The sulfurized composition used as component B is prepared by reacting a mixture comprising reagents B-1, B-2 and B-3 with a sulfurizing agent at a temperature between about 100° and about 250° C., usually between about 150° and about 210° C. The sulfurizing reagent may be, for example, sulfur, a sulfur halide such as sulfur monochloride or sulfur dichloride, a mixture of hydrogen sulfide and sulfur dioxide, or the like. Elemental sulfur is often preferred and the invention especially contemplates the use of sulfurized compositions prepared by reacting sulfur with the aforesaid mixture. The weight ratio of the combination of reagents B-1, B-2 and B-3 to sulfur is between about 5:1 and about 15:1, generally between about 5:1 and about 10:1.

In addition to the above-described reagents, the reaction mixture may contain other materials. These may include, for example, sulfurization promoters, typically phosphorus-containing reagents such as phosphorus acid esters (e.g., triphenyl phosphite), and surface active agents such as lecithin.

The sulfurization reaction is effected by merely heating the reagents at the temperature indicated above, usually with efficient agitation and in an inert atmosphere (e.g., nitrogen). If any of the reagents, especially reagent B-3, are appreciably volatile at the reaction temperature, the reaction vessel may be maintained under pressure. It is frequently advantageous to add sulfur portionwise to the mixture of the other reagents. While it is usually preferred that the reaction mixture consist entirely of the reagents previously described, the reaction may also be effected in the presence of a substantially inert organic diluent (e.g., an alcohol, ether, ester, aliphatic hydrocarbon, halogenated aromatic hydrocarbon or the like) which is liquid within the temperature range employed. When the reaction temperature is relatively high, e.g., about 200° C., there may be some evolution of sulfur from the product which is avoided if a lower reaction temperature (e.g., from about 150° to about 170° C.) is used. However, the reaction sometimes requires a longer time at lower temperatures and an adequate sulfur content is usually obtained when the temperature is at the high end of the recited range.

Following the reaction, volatile materials may be removed by blowing with air or nitrogen and insoluble byproducts by filtration, usually at an elevated temperature (from about 80° to about 120° C.). The filtrate is the desired sulfurized product.

U.S. Pat. Nos. 3,926,822 and 3,953,347 are incorporated by reference herein for their disclosures of suitable sulfurized compositions useful as component B. Several specific sulfurized compositions are described in Examples 10–18 of 3,926,822 and 10–19 of 3,953,347. The following example illustrates the preparation of one such composition. (In the specification and claims, all parts and percentages are by weight unless otherwise indicated.)

EXAMPLE 1

A mixture of 100 parts of soybean oil, 5.25 parts of tall oil acid and 44.8 parts of commercial $C_{15-18}$ straight chain α-olefins is heated to 167° C. under nitrogen, and 17.4 parts of sulfur is added. The temperature of the mixture rises to 208° C. Nitrogen is blown over the surface at 165°–200° C. for 6 hours and the mixture is then cooled to 90° C. and filtered. The filtrate is the desired product and contains 10.6% sulfur.

COMPONENT C—THE BASIC ALKALI METAL SALT OR COMPLEX

The third essential component in the compositions of this invention is at least one oil-dispersible basic alkali metal sulfonate. This component is among those art-recognized metal-containing compositions variously referred to by such names as "basic", "superbased" and "overbased" salts or complexes. The method for their preparation is commonly referred to as "overbasing". The term "metal ratio" is often used to define the quantity of metal in these salts or complexes relative to the quantity of organic anion, and is defined as the ratio of the number of equivalents of metal to the number of equivalents thereof which would be present in a normal salt based upon the usual stoichiometry of the compounds involved.

The term "oil-dispersible" as used herein means that the composition is capable of being stably dispersed in oil to an extent which allows it to function in its intended manner. Thus, it is sufficient that the composition be capable of being stably suspended in oil in an amount sufficient to enable the oil to possess one or more of the desired properties imparted to it by the suspended composition. The composition will preferably be soluble in oil, but need not be soluble in order to be oil-dispersible. Thus, the "oil-dispersible" is used in a conventional manner and will be understood to those of ordinary skill in the art.

The basic alkali metal salts or complexes suitable for use as component C typically have metal ratios from about 4 to about 40, preferably from about 6 to about 30 and especially from about 8 to about 25. They may be conveniently prepared by intimately contacting for a period of time sufficient to form a stable dispersion, at a temperature between the solidification temperature of the reaction mixture and its decomposition temperature:

(C-1) At least one acidic gaseous material selected from the group consisting of carbon dioxide, hydrogen sulfide, sulfur dioxide, and mixtures thereof, with (C-2) a reaction mixture comprising (C-2-a) at least one oil-soluble sulfonic acid, or derivative thereof susceptible to overbasing;

(C-2-b) at least one alkali metal or basic alkali metal compound;

(C-2-c) at least one lower aliphatic alcohol; and (C-2-d) at least one oil-soluble carboxylic acid or functional derivative thereof.

Reagent C-1 is at least one acidic gaseous material which may be carbon dioxide, hydrogen sulfide or sulfur dioxide; mixtures of these gases are also useful. Carbon dioxide is preferred because of its relatively low cost, availability, ease of use and performance.

Reagent C-2 is a mixture containing at least four components of which component C-2-a is at least one oil-soluble sulfonic acid, or a derivative thereof susceptible to overbasing. Mixtures of sulfonic acids and/or their derivatives may also be used, but for the sake of simplicity, frequent reference hereinafter will be to the individual sulfonic acids and derivatives which exemplify those which are useful. They may typically be represented by the formulas $R^1(SO_3H)_r$ and $(R^2)_xT(SO_3H)_y$. In these formulas, $R^1$ is an aliphatic or aliphatic-substituted cycloaliphatic hydrocarbon or essentially hydrocarbon radical free from acetylenic unsaturation and containing up to about 60 carbon atoms. When $R^1$ is aliphatic, it usually contains at least about 15–18 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein, the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and radicals derived from petroleum, saturated and unsaturated paraffin wax, and olefin polymers including polymerized monoolefins and diolefins containing about 1–8 carbon atoms per olefinic monomer unit. $R^1$ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially aliphatic character thereof is not destroyed.

$R^2$ is generally a hydrocarbon or essentially hydrocarbon radical free from acetylenic unsaturation and containing from about 4 to about 60 and preferably from about 30 to about 60 aliphatic carbon atoms, and is usually an aliphatic hydrocarbon radical such as alkyl or alkenyl. It may also, however, contain substituents or interrupting groups such as those enumerated above provided the essentially hydrocarbon character thereof is retained. In general, the non-carbon atoms present in $R^1$ or $R^2$ do not account for more than 10% of the total weight thereof.

The radical T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–4 per molecule and are generally also 1.

Illustrative sulfonic acids useful as component C-2-a are mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, di-lauryl beta-naphthol sulfonic acids, dicapryl nitronaphthalene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well known in the art and require no further discussion herein.

Sulfonic acid derivatives susceptible to over-basing include their metal salts, especially the alkaline earth, zinc and lead salts; ammonium salts and amine salts (e.g., the ethylamine, butylamine and ethylene polyamine salts); and esters such as the ethyl, butyl, and glycerol esters.

For the purpose of this invention, the equivalent weight of a sulfonic acid or derivative thereof is its molecular weight divided by the number of sulfonic acid groups or sulfonic acid derivative groups present therein. Thus, for a monosulfonic acid the equivalent weight is equal to the molecular weight.

Component C-2-b is at least one alkali metal or a basic compound thereof. Suitable alkali metals include lithium, sodium and potassium, with sodium being preferred. Illustrative of basic alkali metal compounds are the hydroxides, alkoxides (typically those in which the alkoxy group contains up to 10 and preferably up to 7 carbon atoms), hydrides and amides. Thus, useful basic alkali metal compounds include sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide and potassium amide. Especially preferred are sodium hydroxide and the sodium lower alkoxides (i.e., those containing up to 7 carbon atoms). The equivalent weight of component C-2-b for the purpose of this invention is equal to its molecular weight, since the alkali metals are monovalent.

Component C-2-c is at least one lower aliphatic alcohol, preferably a monohydric or dihydric alcohol. Illustrative alcohols are methanol, ethanol, 1-propanol, 1-hexanol, isopropanol, isobutanol, 2-pentanol, 2,2-dimethyl-1-propanol, ethylene glycol, 1-3-propanediol and 1,5-pentanediol. Of these, the preferred alcohols are methanol, ethanol and propanol, with methanol being especially preferred. The equivalent weight of component C-2-c is its molecular weight divided by the number of hydroxy groups per molecule.

Component C-2-d is at least one oil-soluble carboxylic acid or functional derivative thereof. Suitable carboxylic acids are those of the formula $R^3(COOH)_n$, wherein n is an integer from 1 to 6 and is preferably 1 to 2 and $R^3$ is a saturated or substantially saturated aliphatic radical (preferably a hydrocarbon radical) having at least 8 aliphatic carbon atoms. Depending upon the value of n, $R^3$ will be a monovalent to hexavalent radical.

Functional derivatives of acids useful as component C-2-d include the anhydrides, esters, amides, imides, amidines and metal salts. Mixtures of the acids and/or functional derivatives are also useful.

$R^3$ may contain non-hydrocarbon substituents provided they do not alter substantially its hydrocarbon character. Such substituents are preferably present in amounts of not more than about 10% by weight. Exemplary substituents include the non-hydrocarbon substituents enumerated hereinabove with reference to component C-2-a. $R^3$ may also contain olefinic unsaturation up to a maximum of about 5% and preferably not more than 2% olefinic linkages based upon the total number of carbon-to-carbon covalent linkages present. The number of carbon atoms in $R^3$ is usually about 8–700 depending upon the source of $R^3$. As discussed below, a preferred series of carboxylic acids and derivatives is prepared by reacting an olefin polymer or halogenated olefin polymer with an $\alpha,\beta$-unsaturated acid or its anhydride such as acrylic, methacrylic, maleic or fumaric acid or maleic anhydride to form the corresponding substituted acid or derivative thereof. The $R^3$ groups in these products have a number average molecular weight from about 150 to about 10,000 and usually from about 700 to about 5000, as determined, for example, by gel permeation chromatography.

The monocarboxylic acids useful as component C-2-d have the formula $R^3COOH$. Examples of such acids are caprylic, capric, palmitic, stearic, isostearic, linoleic and behenic acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula $$\begin{array}{l} R^4CHCOOH \\ \quad\;\; | \\ \quad\;\; CH_2COOH \end{array}$$

wherein $R^4$ is the same as $R^3$ as defined above. $R^4$ may be an olefin polymer-derived group formed by polymerization of such monomers as ethylene, propylene, 1-butene, isobutene, 1-pentene, 2-pentene, 1-hexene and 3-hexene. $R^4$ may also be derived from a high molecular weight substantially saturated petroleum fraction. The hydrocarbon-substituted succinic acids and their derivatives constitute the most preferred class of carboxylic acids for use as component C-2-d.

The above-described classes of carboxylic acids derived from olefin polymers, and their derivatives, are well known in the art, and methods for their preparation as well as representative examples of the types useful in the present invention are described in detail in the following U.S. Pat. Nos.:

| | | |
|---|---|---|
| 3,172,892 | 3,316,771 | 3,522,179 |
| 3,216,936 | 3,373,111 | 3,542,678 |
| 3,219,666 | 3,381,022 | 3,542,680 |
| 3,271,310 | 3,341,542 | 3,579,450 |
| 3,272,746 | 3,344,170 | 3,632,510 |
| 3,278,550 | 3,448,048 | 3,632,511 |
| 3,281,428 | 3,454,607 | 3,639,242 |
| 3,306,908 | 3,515,669 | |

Some of the functional derivatives of the above-discussed acids useful as component C-2-d are the amides, esters and salts. The reaction products of olefin polymer-substituted succinic acids and mono- or polyamines, particularly polyalkylene polyamines, having up to about ten amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. These products are disclosed and exemplified in U.S. Pat. Nos. 3,018,250; 3,024,195; 3,172,892; 3,216,936; 3,219,666; and 3,272,746. Included in this group of functional derivatives are the compositions prepared by post-treating the amine-anhydride reaction product with carbon disulfide, boron compounds, nitriles, urea, thiourea, guanidine, alkylene oxides or the like as disclosed and exemplified in U.S. Pat. Nos. 3,200,107; 3,256,185; 3,087,936; 3,254,025; 3,281,428; 3,278,550; 3,312,619; and British Specification 1,053,577. The half-amide, half-metal salt and half-ester, half-metal salt derivatives of such substituted succinic acids are also useful. These products are disclosed in U.S. Pat. Nos. 3,163,603 and 3,522,179.

Also useful are the esters prepared by the reaction of the substituted acids or anhydrides with a mono- or polyhydroxy compound, such as an aliphatic alcohol or a phenol. Typical esters of this type are disclosed in British Specification No. 981,850 and U.S. Pat. Nos. 3,311,558 and 3,522,179. Preferred are the esters of olefin polymer-substituted succinic acids or anhydrides and polyhydric aliphatic alcohols containing 2–10 hydroxy groups and up to about 40 aliphatic carbon atoms. This class of alcohols includes ethylene glycol, glycerol, sorbitol, pentaerythritol, polyethylene glycol, diethanolamine, triethanolamine, N,N'-di(hydroxyethyl)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides, as disclosed in U.S. Pat. No. 3,324,033.

Suitable monocarboxylic acid derivatives and methods for their preparation are disclosed in detail in British Patent Specification No. 1,075,121 and U.S. Pat. Nos. 3,272,746; 3,340,281; 3,341,542; and 3,342,733.

The foregoing U.S. patents and foreign specifications are incorporated herein by reference for their disclosures of suitable acids and acid derivatives and the process for their preparation.

The equivalent weight of a compound useful as component C-2-d is its molecular weight divided by the number of carboxy groups (or groups derived therefrom) present therein.

The ratios of equivalents of the constituents of reagent C-2 may vary widely. In general, the ratio of component C-2-b to C-2-a is at least about 4:1 and usually not more than about 40:1, preferably between 6:1 and 30:1 and most preferably between 8:1 and 25:1. While this ratio may sometimes exceed 40:1, such an excess normally will serve no useful purpose.

The ratio of equivalents of component C-2-c to component C-2-a is between about 1:1 and 80:1, and preferably between about 2:1 and 50:1; and the ratio of equivalents of component C-2-d to component C-2-a is from about 1:1 to about 1:20 and preferably from about 1:2 to about 1:10.

Reagents C-1 and C-2 are generally contacted until there is no further reaction between the two or until the reaction substantially ceases. While it is usually preferred that the reaction be continued until no further overbased product is formed, useful dispersions can be prepared when contact between reagents C-1 and C-2 is maintained for a period of time sufficient for about 70% of reagent C-1, relative to the amount required if the reaction were permitted to proceed to its completion or "end point", to react.

The point at which the reaction is completed or substantially ceases may be ascertained by any of a number of conventional methods. One such method is measurement of the amount of gas (reagent C-1) entering and leaving the mixture; the reaction may be considered substantially complete when the amount leaving is about 90–100% of the amount entering. These amounts are readily determined by the use of metered inlet and outlet valves.

The reaction temperature is not critical. Generally, it will be between the solidification temperature of the reaction mixture and its decomposition temperature (i.e., the lowest decomposition temperature of any component thereof). Usually, the temperature will be from about 25° to about 200° C. and preferably from about 50° to about 150° C. Reagents C-1 and C-2 are conveniently contacted at the reflux temperature of the mixture. This temperature will obviously depend upon the boiling points of the various components; thus, when methanol is used as component C-2-c, the contact temperature will be about the reflux temperature of methanol.

The reaction is ordinarily conducted at atmospheric pressure, although superatmospheric pressure often expedites the reaction and promotes optimum utilization of reagent C-1. The process can also be carried out at reduced pressure but, for obvious practical reasons, this is rarely done.

The reaction is usually conducted in the presence of a substantially inert, normally liquid organic diluent, which functions as both the dispersing and reaction medium. This diluent will comprise at least about 10% of the total weight of the reaction mixture. Ordinarily it will not exceed about 80% by weight, and it is preferably about 30–70% thereof.

Although a wide variety of diluents are useful, it is preferred to use a diluent which is soluble in lubricating oil. The diluent usually itself comprises a low viscosity lubricating oil.

Other organic diluents can be employed either alone or in combination with lubricating oil. Preferred diluents for this purpose include the aromatic hydrocarbons such as benzene, toluene and xylene; halogenated derivatives thereof such as chlorobenzene; lower boiling petroleum distillates such as petroleum ether and the various naphthas; normally liquid aliphatic and cycloaliphatic hydrocarbons such as hexane, heptane, hexene, cyclohexene, cyclopentane, cyclohexane and ethylcyclohexane, and their halogenated derivatives. Dialkyl ketones such as dipropyl ketone and ethyl butyl ketone, and the alkyl aryl ketones such as acetophenone, are likewise useful, as are ethers such as n-propyl ether, n-butyl ether, n-butyl methyl ether and isoamyl ether.

When a combination of oil and other diluent is used, the weight ratio of oil to the other diluent is generally from about 1:20 to about 20:1. It is usually desirable for a mineral lubricating oil to comprise at least about 50% by weight of the diluent, especially if the product is to be used as a lubricant additive. The total amount of diluent present is not particularly critical since it is inactive. However, the diluent will ordinarily comprise about 10–80% and preferably about 30–70% by weight of the reaction mixture.

The reaction is preferably conducted in the absence of water, although small amounts may be present (e.g., those through the use of technical grade reagents). Water may be present in amounts up to about 10% by weight of the reaction mixture without having harmful effects.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture since the presence of water may lead to difficulties in filtration and to the formation of undesirable emulsions in fuels and lubricants. Any such water present is readily removed by heating at atmospheric or reduced pressure or by azeotropic distillation.

The chemical structure of component C is not known with certainty. The basic salts or complexes may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

British Patent 1,481,553 is incorporated by reference herein for its disclosure of compositions suitable for use as component C and methods for their preparation. Examples 1–12 of the British patent furnish specific methods of preparation of a number of useful basic alkali metal salts or complexes. One such useful composition is illustrated by the following example.

EXAMPLE 2

To a solution of 780 parts (1 equivalent) of an alkylated benzenesulfonic acid and 119 parts of a polybutenyl succinic anhydride (equivalent weight about 560) containing predominantly isobutene units in 442 parts of mineral oil is added 800 parts (20 equivalents) of sodium hydroxide and 704 parts (22 equivalents) of methanol. The temperature of the mixture increases as the sodium hydroxide and methanol are added. The mixture is blown with carbon dioxide at 7 cfh. (cubic feet per hour) for 11 minutes as the temperature slowly increases to 97° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

COMPONENT D—THE DETERGENT OR DISPERSANT

Optional component D is at least one oil-dispersible detergent or dispersant, with the proviso that if it is a detergent it is not a basic alkali metal salt (component C).

The terms "detergent" and "dispersant" as used in the lubricant art generally mean, respectively, a composition which is capable of removing deposits from engine parts and a composition which is capable of retaining such deposits in suspension in the oil once they are removed. For the most part, detergents comprise basic metal salts or complexes of various organic compositions (normally acidic) containing both a polar and a non-polar group, while dispersants comprise compositions also containing a polar and a non-polar group but which are metal-free or, if they contain metal, contain at most about 1.1 equivalents thereof per equivalent of acidic moieties. Both detergents and dispersants will be more fully characterized hereinafter, although their general nature is well known to the skilled lubricant chemist.

DETERGENTS

As noted above, most detergents are basic metal salts or complexes. The metals are usually alkali metals or alkaline earth metals; that is, they are members respectively of Group IA and Group IIA of the Periodic Table. For the purpose of the present invention, component D, if a detergent, is an alkaline earth metal salt since any basic alkali metal salt which is present will constitute component C. The preferred alkaline earth metals are magnesium, calcium, strontium and barium, particularly calcium or barium and still more particularly calcium.

The non-metallic moiety of the salt or complex is ordinarily the anion of an organic acidic compound. Examples of such compounds are phenols, sulfonic acids, carboxylic acids and phosphorus acids.

The word "phenol", as used herein, denotes any hydroxyaromatic compound including hydroxy compounds derived from fused-ring hydrocarbons (e.g., naphthols and the like). Especially preferred in the preparation of component D are phenols substituted with aliphatic or cycloaliphatic radicals having at least about 6 carbon atoms and up to as many as 7000 carbon atoms. Examples of such radicals are hexyl, cyclohexyl, heptyl, decyl, eicosyl, and radicals derived from the polymerization of olefins such as ethylene, propylene, 1-butene, 2-butene, isobutene and the like. Radicals derived from polymers of propylene and commercial mixtures of butenes (comprising predominantly isobutene) are preferred, especially those having a number average molecular weight (as determined, for example, by gel permeation chromatography) of about 150–1750 (containing about 10–125 aliphatic carbon atoms). The substituent and the aryl nucleus of the phenol may contain other radicals such as hydroxy, nitro, nitroso and sulfo radicals.

Introduction of the aliphatic or cycloaliphatic substituent onto the phenol can be effected by mixing the hydrocarbon (or a halogenated derivative thereof, or the like) and the phenol at a temperature of about 50°–200° C. in the presence of a suitable catalyst, such as aluminum trichloride, boron trifluoride, zinc chloride or the like. The radical can also be introduced by other alkylation processes known in the art. It is irrelevant which position on the phenolic ring is substituted; any single isomer, or a mixture of isomers, may be used. Polysubstituted materials such as dialkyl and trialkyl phenols may also be present, either alone or in admixture with monoalkyl phenols.

Additional suitable phenols are polyphenols containing sulfur or alkylene bridges, typically prepared by reaction of a simple phenol with sulfur, a sulfur halide such as sulfur monochloride or dichloride, or a lower aliphatic aldehyde (preferably formaldehyde). Polyphenols containing both sulfur and alkylene bridges are also suitable.

The equivalent weight of a phenol for the purpose of this invention is its molecular weight divided by the number of phenolic hydroxy groups therein. Thus, the equivalent weight of an alkylated phenol is equal to its molecular weight and that of an alkylated resorcinol is half its molecular weight.

The phosphorus acids useful in the preparation of component D may contain pentavalent or trivalent phosphorus. The pentavalent phosphorus acids, which are preferred, may be represented by the formula

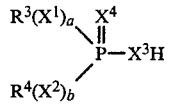

wherein each of $R^3$ and $R^4$ is hydrogen or a hydrocarbon-based radical, at least one thereof being hydrocarbon-based; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

The term "hydrocarbon-based" as used herein denotes a radical having a carbon atom directly attached to the remainder of the molecule and having predominantly hydrocarbon character within the context of this invention. Such radicals include the following:

(1) Hydrocarbon radicals; that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical).

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples include nitro, hydroxy, RO-, RS-,

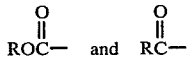

(R being a hydrocarbon radical and especially a lower alkyl radical).

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

Included among the suitable phosphorus acids are those prepared by the treatment of an olefin polymer (e.g., a polybutene having a molecular weight of about 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

The equivalent weight of a phosphorus acid is its molecular weight divided by the number of hydroxy groups bonded to phosphorus therein.

Carboxylic acids suitable for use in the preparation of component D include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids (including salicyclic acids). The aliphatic acids generally contain at least 8 and preferably at least 12 carbon atoms. The cycloaliphatic and aliphatic carboxylic acids can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentanecarboxylic acid, myristic acid, dilauryldecahydronaphthalenecarboxylic acid, stearyl-octahydroindenecarboxylic acid, palmitic acid, acids formed by oxidation of petrolatum or of hydrocarbon waxes, and commercially available mixtures of two or more carboxylic acids such as tall oil acids, rosin acids, and the like. The equivalent weight of any such acid is its molecular weight divided by the number of carboxy groups present therein.

The sulfonic acids useful in the preparation of detergents suitable for use as component D are the same as those described hereinabove with reference to component C.

The basic salts and complexes useful as component D are well known in the art and are disclosed in many U.S. Pat. Nos. of which the following are exemplary:

| | | |
|---|---|---|
| 2,616,904 | 3,031,284 | 3,410,671 |
| 2,616,905 | 3,256,186 | 3,437,465 |
| 2,695,910 | 3,312,618 | 3,629,109 |
| 2,723,234 | 3,342,733 | 3,746,643 |
| 2,777,874 | 3,350,308 | 3,764,533 |
| 2,781,403 | 3,410,670 | |

The above patents as well as German published application 1,243,915 are incorporated by reference herein for their disclosures of basic salts and complexes. The salts and complexes useful in the present invention are those disclosed in said patents both generically and in working examples, and include those disclosed merely as intermediates for conversion into more highly basic salts and complexes.

The commonly employed method for the preparation of these basic salts and complexes involves heating a solution of the organic acid compound in a substantially inert, normally liquid organic diluent such as mineral oil with a stoichiometric excess of a metal neutralizing agent such as the oxide, hydroxide, carbonate, bicarbonate or sulfide at a temperature above 50° C. and filtering the resulting mass. A "promoter" is often used in the neutralization step to aid the incorporation of a large excess of metal. Examples of compounds useful as promoters include phenolic compounds such as phenol, naphthol, alkylphenols, thiophenols, sulfurized alkylphenols, and condensation products of phenols with formaldehyde; alcohols such as methanol, 2-propanol, octyl alcohol, Cellosolve, Carbitol, ethylene glycol, stearyl alcohol and cyclohexyl alcohol; and amines such as aniline, phenylene diamine, phenothiazine, phenyl-$\beta$-naphthylamine and dodecylamine. It is also frequently preferred to further treat the basic compound prepared as described above with an acidic gas, especially carbon dioxide. This treatment may be intermittent and followed by successive treatments with the metal neutralizing agent, and often enables the incorporation of still larger amounts of basic metal in the complex.

The preferred organic acidic compounds for use in the preparation of the detergent are the above-described sulfonic and carboxylic acids, especially those having an equivalent weight of about 300–500. The sulfonic acids are most often used, and a particular preference is expressed for alkylaromatic sulfonic acids and more particularly for alkylbenzene sulfonic acids.

DISPERSANTS

Oil-dispersible dispersants are particularly useful as component D in the present invention. As previously noted, these dispersants are generally metal-free or contain relatively small amounts of metal in comparison to the detergents described above. Their characterizing feature, with respect to molecular structure, is the presence of an oil-solubilizing group containing at least about 40 aliphatic carbon atoms bonded directly to a polar group. The dispersant may contain more than one of either of such groups per molecule, as will be apparent from the description hereinafter.

Many dispersants of this type are known in the art and are described in various patents. Any of such dispersants are suitable for use in the compositions and methods of this invention. The following are illustrative:

(1) Reaction products of carboxylic acids (or derivatives thereof) containing at least about 44 and preferably at least about 54 aliphatic carbon atoms with nitrogen-containing compounds such as amines, ureas and hydrazines, with organic hydroxy compounds such as phenols and alcohols, and/or with basic inorganic materials. Examples of these products, referred to herein as "carboxylic dispersants", are described in British Pat. No. 1,306,529 and in many U.S. Pat. Nos. including the following:

| | | |
|---|---|---|
| 3,163,603 | 3,351,552 | 3,541,012 |
| 3,184,474 | 3,381,022 | 3,542,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | Re 26,433 |
| 3,346,493 | 3,522,179 | |

(2) Reaction products of aliphatic or alicyclic halides containing at least about 40 carbon atoms with amines, preferably polyalkylene polyamines. These may be characterized as "amine dispersants" and examples thereof are described, for example, in the following U.S. Pat. Nos.:

| | |
|---|---|
| 3,275,554 | 3,454,555 |
| 3,438,757 | 3,565,804 |

(3) Reaction products of alkyl phenols in which the alkyl group contains at least about 40 carbon atoms with aliphatic aldehydes containing at most about 7 carbon atoms (especially formaldehyde) and amines (especially alkylene polyamines), which may be characterized as "Mannich dispersants". The materials described in the following U.S. Pat. Nos. are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(4) Polymers containing an oil-solubilizing group (e.g., a pendant alkyl group having at least about 8 carbon atoms) and a polar group. Illustrative are interpolymers of decyl methacrylate, vinyl decyl ether or a relatively high molecular weight olefin with aminoalkyl acrylates, aminoalkyl acrylamides or poly-(oxyalkylene)-substituted alkyl acrylates, as well as copolymers of styrene, alkyl maleates and maleic acid amines or imides. These may be characterized as "polymeric dispersants" and examples thereof are disclosed in the following U.S. Pat. Nos.:

| | |
|---|---|
| 3,329,658 | 3,666,730 |
| 3,449,250 | 3,687,849 |
| 3,519,565 | 3,702,300 |

(5) Products obtained by post-treating the carboxylic, amine, Mannich or polymeric dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in German published application (OLS) No. 2,551,256 and in the following U.S. Pat. Nos.:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

The pertinent disclosures of all of the above-listed patents and applications are incorporated by reference herein.

The carboxylic and Mannich dispersants are preferred. Carboxylic dispersants may be most conveniently and accurately described in terms of radicals D-1 and D-2 present therein. Radical D-1 is usually an acyl, acyloxy or acylimidoyl radical containing at least about 44 carbon atoms. The structures of these radicals, as defined by the International Union of Pure and Applied Chemistry, are as follows (each R′ individually representing a hydrocarbon or similar group):

Acyl: $R'-\overset{\overset{\displaystyle O}{\|}}{C}-$

-continued

Acyloxy: $R'-\overset{\overset{\displaystyle O}{\|}}{C}-O-$

Acylimidoyl: $R'-\overset{\overset{\displaystyle NR'}{\|}}{C}-$

Radical D-2 is preferably at least one radical in which a nitrogen or oxygen atom is attached directly to said acyl, or acyloxy or acylimidoyl radical, said nitrogen or oxygen atom also being attached to a hydrocarbon-based radical. With respect to radical D-2, the carboxylic dispersants are conveniently classified as "nitrogen-bridged dispersants" and "oxygen-bridged dispersants" wherein the atom attached directly to radical D-1 is nitrogen or oxygen respectively.

The nitrogen-bridged dispersants, which will be described first, are those disclosed (for example) in the above-mentioned U.S. Pat. Nos. 3,219,666 and 3,272,746 which also describe a large number of methods for their preparation. The nitrogen-containing group therein is derived from compounds characterized by a radical of the structure >NH wherein the two remaining valences of nitrogen are satisfied by hydrogen, amino or organic radicals bonded to said nitrogen atom through direct carbon-to-nitrogen linkages. These compounds include aliphatic, aromatic, heterocyclic and carbocyclic amines as well as substituted ureas, thioureas, hydrazines, guanidines, amidines, amides, thioamides, cyanamides and the like.

Among the amines useful in preparing the nitrogen-bridged dispersant are monoamines. These monoamines can be secondary, i.e., those containing only one hydrogen atom bonded directly to an amino nitrogen atom. Preferably, however, they contain at least one primary amino group, i.e., a group wherein an amino nitrogen atom is directly bonded to two hydrogen atoms. The monoamines are generally substituted with $C_{1-30}$ hydrocarbon-based radicals. Preferably these hydrocarbon-based radicals are aliphatic in nature and free from acetylenic unsaturation and contain from about 1 to about 10 carbon atoms. Saturated aliphatic hydrocarbon radicals are particularly preferred.

Among the preferred monoamines are those of the general formula $HNR^1R^2$, wherein $R^1$ is an alkyl radical of up to ten carbon atoms and $R^2$ is hydrogen or an alkyl radical of up to ten carbon atoms. Other preferred monoamines are aromatic monoamines of the general formula $HNR^3R^4$ wherein $R^3$ is a phenyl, alkylated phenyl, naphthyl or alkylated naphthyl radical of up to 10 carbon atoms and $R^4$ is a hydrogen atom, an alkyl radical of up to 10 carbon atoms, or a radical similar to $R^3$. Examples of suitable monoamines are ethylamine, diethylamine, n-butylamine, di-n-butylamine, allylamine, isobutylamine, cocoamine, stearylamine, laurylamine, methyllaurylamine, oleylamine, aniline, methylaniline, N-methylaniline, diphenylamine, benzylamine, tolylamine and methyl-2-cyclohexylamine.

Hydroxy amines are also included in the class of useful monoamines. Such compounds are the hydroxyhydrocarbyl-substituted analogs of the afore-described monoamines. Preferred hydroxy monoamines have the formulas $HNR^5R^6$ and $HNR^7R^8$, wherein $R^5$ is an alkyl or hydroxy-substituted alkyl radical of up to 10 carbon atoms, $R^6$ is hydrogen or a radical similar to $R^5$, $R^7$ is a hydroxy-substituted phenyl, alkylated phenyl, naphthyl or alkylated naphthyl radical of up to 10 carbon atoms, and $R^8$ is hydrogen or a radical similar to $R^7$, at least one of $R^5$ and $R^6$ and at least one of $R^7$ and $R^8$ being hydroxy-substituted.

Suitable hydroxy-substituted monoamines include ethanolamine, di-3-propanolamine, 4-hydroxybutylamine, diethanolamine, N-methyl-2-propylamine, 3-hydroxyaniline, N-hydroxyethylethylene diamine, N,N-di-(hydroxypropyl)propylene diamine and tris(hydroxymethyl)methylamine. While in general, hydroxy amines containing only one hydroxy group will be employed as reactants, those containing more can also be used.

Heterocyclic amines are also useful in making the nitrogen-bridged dispersant, provided they contain a primary or secondary amino group. The heterocyclic ring can also incorporate unsaturation and can be substituted with hydrocarbon radicals such as alkyl, alkenyl, aryl, alkaryl or aralkyl. In addition, the ring can also contain other hetero atoms such as oxygen, sulfur, or other nitrogen atoms including those not having hydrogen atoms bonded to them. Generally, these rings have from about 3 to about 10, preferably 5 or 6, ring members. Among such heterocycles are aziridines, azetidines, azolidines, pyridines, pyrroles, piperidines, imidazoles, indoles, piperazines, isoindoles, purines, morpholines, thiamorpholines, N-aminoalkyl morpholines, N-aminoalkyl thiamorpholines, azepines, azocines, azonines, azecines and tetrahydro-, dihydro- and perhydro-derivatives of each of the above. Preferred heterocyclic amines are the saturated ones with 5- and 6-membered rings, especially the piperidines, piperazines and morpholines described above.

Polyamines are preferred for preparing the nitrogen-bridged dispersant. Among the polyamines are alkylene polyamines (and mixtures thereof) including those having the formula

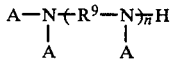

wherein n is an integer between about 1 and about 10, preferably between 2 and 8; each A is independently hydrogen or a hydrocarbon or hydroxy-substituted hydrocarbon radical having up to about 30 atoms; and $R^9$ is a divalent hydrocarbon radical having from about 1 to about 18 carbons. Preferably A is an aliphatic radical of up to about 10 carbon atoms which may be substituted with one or two hydroxy groups, and $R^9$ is a lower alkylene radical having 1–10, preferably 2–6, carbon atoms. Especially preferred are the alkylene polyamines wherein each A is hydrogen. Such alkylene polyamines include methylene polyamines, ethylene polyamines, butylene polyamines, propylene polyamines, pentylene polyamines, hexylene polyamines and heptylene polyamines. The higher homologs of such amines and related aminoalkyl-substituted piperazines are also included. Specific examples of such polyamines include ethylene diamine, triethylene tetramine, tris(2-aminoethyl)amine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(-trimethylene)triamine, 2-heptyl-3-(2-aminopropyl-)imidazoline; 1,3-bis-(2-aminoethyl)imidazoline, 1-(2-aminopropyl)-piperazine, 1,4-bis(2-aminoethyl)piperazine and 2-methyl-1-(2-aminobutyl)-piperazine. Higher homologs, obtained by condensing two or more of the above-illustrated alkylene amines, are also useful, as are the polyoxyalkylene polyamines (e.g., "Jeffamines").

The ethylene polyamines, examples of which are mentioned above, are especially useful for reasons of cost and effectiveness. Such polyamines are described in detail under the heading "Diamines and Higher Amines" in Kirk-Othmer, *Encyclopedia of Chemical Technology,* Second Edition, Vol. 7, pp. 22–39. They are prepared most conveniently by the reaction of an alkylene chloride with ammonia or by reaction of an ethylene imine with a ring-opening reagent such as ammonia. These reactions result in the production of the somewhat complex mixtures of alkylene polyamines, including cyclic condensation products such as piperazines. Because of their availability, these mixtures are particularly useful in preparing the nitrogen-bridged dispersant. Satisfactory products can also be obtained by the use of pure alkylene polyamines.

Hydroxy polyamines, e.g., alkylene polyamines having one or more hydroxylalkyl substituents on the nitrogen atoms, are also useful in preparing the nitrogen-bridged dispersant. Preferred hydroxyalkyl-substituted alkylene polyamines are those in which the hydroxyalkyl group has less than about 10 carbon atoms. Examples of such hydroxyalkyl-substituted polyamines include N-(2-hydroxyethyl)ethylene diamine, N,N'-bis(2-hydroxyethyl)ethylene diamine, 1-(2-hydroxyethyl)-piperazine, monohydroxypropyl-substituted diethylene triamine, dihydroxypropyltetraethylene pentamine and N-(3-hydroxybutyl)tetramethylene diamine. Higher homologs obtained by condensation of the above-illustrated hydroxyalkyl-substituted alkylene amines through amino radicals or through hydroxy radicals are likewise useful.

The source of radical D-1 in the nitrogen-bridged dispersant is an acylating agent comprising a carboxylic acid-producing compound containing a hydrocarbon or substituted hydrocarbon substituent which has at least about 40 and preferably at least about 50 carbon atoms. By "carboxylic acid-producing compound" is meant an acid, anhydride, acid halide, ester, amide, imide, amidine or the like; the acids and anhydrides are preferred.

The carboxylic acid-producing compound is usually prepared by the reaction (more fully described hereinafter) of a relatively low molecular weight carboxylic acid or derivative thereof with a hydrocarbon source containing at least about 40 and preferably at least about 50 carbon atoms. The hydrocarbon source is usually aliphatic and should be substantially saturated, i.e., at least about 95% of the total number of carbon-to-carbon covalent linkages should be saturated. It should also be substantially free from pendant groups containing more than about six aliphatic carbon atoms. It may be a substituted hydrocarbon source; by "substituted" is meant sources containing substituents which do not alter significantly their character or reactivity. Examples are halide, hydroxy, ether, keto, carboxy, ester (especially lower carbalkoxy), amide, nitro, cyano, sulfoxy and sulfone radicals. The substituents, if present, generally comprise no more than about 10% by weight of the hydrocarbon source.

The preferred hydrocarbon sources are those derived from substantially saturated petroleum fractions and olefin polymers, particularly polymers of monoolefins having from 2 to about 30 carbon atoms. Thus, the hydrocarbon source may be derived from a polymer of ethylene, propane, 1-butene, isobutene, 1-octene, 3-cyclohexyl-1-butene, 2-butene, 3-pentene or the like. Also useful are interpolymers of olefins such as those illustrated above with other polymerizable olefinic substances such as styrene, chloroprene, isoprene, p-methylstyrene, piperylene and the like. In general, these interpolymers should contain at least about 80%, preferably at least about 95%, on a weight basis of units derived from the aliphatic monoolefins.

Another suitable hydrocarbon source comprises saturated aliphatic hydrocarbons such as highly refined high molecular weight white oils or synthetic alkanes.

In many instances, the hydrocarbon source should contain an activating polar radical to facilitate its reaction with the low molecular weight acid-producing compound. The preferred activating radicals are halogen atoms, especially chlorine, but other suitable radicals include sulfide, disulfide, nitro, mercaptan, ketone and aldehyde groups.

As already pointed out, the hydrocarbon sources generally contain at least about 40 and preferably at least about 50 carbon atoms. Among the olefin polymers those having a number average molecular weight between about 600 and about 5000 (as determined by gel permeation chromatography) are preferred, although higher polymers having molecular weights from about 10,000 to about 100,000 or higher may sometimes be used. Especially suitable as hydrocarbon sources are isobutene polymers within the prescribed molecular weight range, and chlorinated derivatives thereof.

Any one of a number of known reactions may be employed for the preparation of the carboxylic acid-producing compound. Thus, an alcohol of the desired molecular weight may be oxidized with potassium permanganate, nitric acid or a similar oxidizing agent; a halogenated olefin polymer may be reacted with a ketene; an ester of an active hydrogen-containing acid, such as acetoacetic acid, may be converted to its sodium derivative and the sodium derivative reacted with a halogenated high molecular weight hydrocarbon such as brominated wax or brominated polyisobutene; a high molecular weight olefin may be ozonized; a methyl ketone of the desired molecular weight may be oxidized by means of the haloform reaction; an organometallic derivative of a halogenated hydrocarbon may be reacted with carbon dioxide; a halogenated hydrocarbon or olefin polymer may be converted to a nitrile, which is subsequently hydrolyzed; or an olefin polymer or its halogenated derivative may undergo a reaction with an unsaturated carboxylic acid or derivative thereof such as acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, 2-pentene-1,3,5-tricarboxylic acid, and the like, or with a halogen-substituted carboxylic acid or derivative thereof. This latter reaction is preferred, especially when the acid-producing compound is unsaturated and preferably when it is maleic acid or anhydride. The resulting product is then a hydrocarbon-substituted succinic acid or derivative thereof. The reaction leading to its formation involves merely heating the two reactants at a temperature from about 100° to about 200° C. The substituted succinic acid or anhydride thus obtained, may, if desired, be converted to the corresponding acid halide by reaction with known halogenating agents such as phosphorus trichloride, phosphorus pentachloride or thionyl chloride.

For the formation of the nitrogen-bridged dispersant, the hydrocarbon-substituted succinic anhydride or acid, or other carboxylic acid-producing compound, and the alkylene polyamine or other nitrogen-containing reagent are heated to a temperature above about 80° C., preferably from about 100° to about 250° C. The product thus obtained has predominantly amide, imide and/or amidine linkages (containing acyl or acylamidoyl groups). The process may in some instances be carried out at a temperature below 80° C. to produce a product having predominantly salt linkages (containing acyloxy groups). The use of a diluent such as mineral oil, benzene, toluene, naphtha or the like is often desirable to facilitate control of the reaction temperature.

The relative proportions of the carboxylic acid-producing compound and the alkylene polyamine or the like are such that at least about one-half the stoichiometrically equivalent amount of polyamine is used for each equivalent of carboxylic acid-producing compound. In this regard it will be noted that the equivalent weight of the alkylene polyamine is based upon the number of amine radicals therein, and the equivalent weight of the carboxylic acid-producing compound is based on the number of acidic or potentially acidic radicals. (Thus, the equivalent weight of a hydrocarbon-substituted succinic acid or anhydride is one-half its molecular weight.) Although a minimum of one-half equivalent of polyamine per equivalent of acylating agent should be used, there does not appear to be an upper limit for the amount of polyamine. If an excess is used, it merely remains in the product unreacted without any apparent adverse effects. Ordinarily, about 1–2 equivalents of polyamine are used per equivalent of acylating agent.

In an alternative method for producing the nitrogen-bridged dispersant, the alkylene polyamine is first reacted with a low molecular weight, unsaturated or halogen-substituted carboxylic acid or derivative thereof (such as maleic anhydride or one of the others previously mentioned) and the resulting intermediate is subsequently reacted with the hydrocarbon source is previously described.

Oxygen-bridged dispersants comprise the esters of the above-described carboxylic acids, as described (for example) in the aforementioned U.S. Pat. Nos. 3,381,022 and 3,542,678. As such, they contain acyl or, occasionally, acylimidoyl radicals as radical D-1. (An oxygen-bridged dispersant containing an acyloxy radical as radical D-1 would be a peroxide, which is unlikely to be stable under all conditions of use of the compositions of this invention.) These esters are preferably prepared by conventional methods, usually the reaction (frequently in the presence of an acidic catalyst) of the carboxylic acid-producing compound with an aliphatic compound such as a monohydric or polyhydric alcohol or with an aromatic compound such as a phenol or naphthol. The hydroxy compounds are usually alcohols containing up to about 40 aliphatic carbon atoms. These may be monohydric alcohols such as methanol, ethanol, isooctanol, dodecanol, cyclohexanol, neopentyl alcohol, monomethyl ether of ethylene glycol and the like, or polyhydric alcohols including ethylene glycol, diethylene glycol, dipropylene glycol, tetramethylene glycol, pentaerythritol, glycerol and the like. Carbohydrates (e.g., sugars, starches, cellulose) are also suitable as are partially esterified derivatives of polyhydric alcohols having at least three hydroxy radicals. Aliphatic polyols containing up to 10 carbon atoms and at least 3 hydroxy groups, especially those with up to 6 carbon atoms and 3–6 hydroxy groups, are preferred.

The esterification reaction is usually effected at a temperature above about 100° C. and typically from about 150° to about 300° C. The esters may be neutral or acidic, or may contain unesterified hydroxy groups, according as the ratio of equivalents of acid-producing compound to hydroxy compound is equal to, greater than or less than 1:1.

It is possible to prepare mixed oxygen- and nitrogen-bridged dispersants by reacting the acylating agent simultaneously or, preferably, sequentially with nitrogen-containing and hydroxy reagents such as those previously described. The relative amounts of the nitrogen-containing and hydroxy reagents may be between about 10:1 and 1:10, on an equivalent weight basis. The methods of preparation of the mixed oxygen- and nitrogen-bridged dispersants are generally the same as for the individual dispersants described, except that two sources of radical D-2 are used. Mixtures of independently prepared dispersants are also suitable. Mixed dispersants of these types are frequently preferred for the purposes of this invention.

Typical carboxylic dispersants suitable for use as reagent D are listed in Table I. "Reagent D-1" and "Reagent D-2" are, respectively, the sources of radicals D-1 and D-2 as previously defined.

TABLE I

| Example | Reagent D-1 | Reagent D-2 | Ratio of equivalents, D-1:D-2 | Reaction temperature, °C. | Diluent |
|---|---|---|---|---|---|
| 3 | Polybutenyl (mol. wt. about 900) succinic anhydride prepared from chlorinated polybutene comprising principally isobutene units | Polyethylene amine mixture containing about 3–7 amino groups per molecule | 0.48 | 150 | Mineral oil |
| 4 | Same as Example 3 | Pentaethylene hexamine | 0.41 | 150 | Mineral oil |
| 5 | Like Example 3 except polybutene mol. wt. is about 1050 | Pentaethylene hexamine | 0.61 | 150 | Mineral oil |
| 6 | Like Example 3, except polybutene mol. wt. is about 850 | Diethylene triamine | 1.0 | 150 | Mineral oil |
| 7 | Same as Example 6 | Ethylene diamine | 1.0 | 150 | Mineral oil |
| 8 | Same as Example 6 | Di-(1,2-propylene)triamine | 1.0 | 180–190 | Mineral oil-toluene |
| 9 | Same as Example 6 | N-(2-hydroxyethyl)-trimethylene diamine | 1.06 | 150–155 | Mineral oil |
| 10 | Same as Example 3 | Pentaerythritol, followed by polyethylene amine of Example 3 (ratio of equivalents 3.4:1) | 0.79 | 205–215 | Xylene |
| 11 | Same as Example 3 | Same as Example 3 | 0.67 | 150 | Mineral oil |
| 12 | Same as Example 3 | Same as Example 3 | 1.33 | 150 | Mineral oil |
| 13 | Like Example 3, except polybutene mol. wt. is about 1100 | Pentaerythritol, followed polyethylene amine of Example 3 (ratio of equivalents 7.7:3) | 0.44 | 150–210 | Mineral oil |
| 14 | Acid produced by reaction of chlorinated (3.6% Cl) polybutene (mol. wt. 750) with KCN, followed by hydrolysis | Ethylene diamine | 2.0 | 150 | Xylene |
| 15 | Methyl ester produced by reaction of chlorinated (4.7% Cl) polybutene (mol. wt. 1000) with methyl methacrylate | Triethylene tetramine | 1.0 | 140–220 | — |
| 16 | Reaction product of sodiomalonic ester with $C_{75}$ brominated wax | Same as Example 3 | 0.4 | 150 | Xylene |
| 17 | Reaction product of chlorinated (4.5% Cl) polybutene (mol. wt. 850) with acrylic acid | Pentaethylene hexamine | 0.8 | 180–200 | — |
| 18 | Acid produced by haloform reaction with methyl heptacontanyl ketone | Same as Example 1 | 0.8 | 180–210 | — |
| 19 | Same as Example 13 | Pentaerythritol | 0.5 | 150–210 | Mineral oil |
| 20 | Like Example 3, except polybutene mol. wt. is about 1000 | Neopentyl glycol | 1.0 | 240–250 | — |
| 21 | Same as Example 20 | Methanol* | Excess methanol | 50–65 | Toluene |
| 22 | Same as Example 20 | Polyethylene glycol (mol. wt. about 600) | 2.0 | 240–250 | — |
| 23 | Same as Example 20 | Oleyl alcohol** | 1.0 | 150–173 | Xylene |
| 24 | Like Example 17, except polybutene mol. wt. is about 982 | Sorbitol | 0.48 | 115–205 | Mineral oil |
| 25 | Same as Example 24 | Pentaerythritol | 1.0 | 180–205 | — |

TABLE I-continued

| Example | Reagent D-1 | Reagent D-2 | Ratio of equivalents, D-1:D-2 | Reaction temperature, °C. | Diluent |
|---|---|---|---|---|---|
| 26 | Reaction product of polybutene (mol. wt. 1500) with chloroacetyl chloride | Mannitol | 0.33 | 115–205 | Mineral oil |

*Hydrogen chloride catalyst
**p-Toluenesulfonic acid catalyst

In the preparation of carboxylic dispersants such as those described in Examples 3–26, reagent D-1 is normally prepared by reacting approximately equimolar amounts of the hydrocarbon source and the low molecular weight carboxylic acid or derivative thereof. It is also within the scope of the invention, however, to use as component D a nitrogen- or oxygen-bridged, or mixed nitrogen- and oxygen-bridged, dispersant prepared by initially reacting substantially more than one mole of acid or acid derivative with one mole of hydrocarbon source. In the preferred dispersants of this type, as in those previously described herein, the hydrocarbon source is an olefin polymer such as polybutene and the carboxylic acid derivative is maleic anhydride. Dispersants of this type usually contain up to about 3.5 and most often from about 1.3 to about 3.5 succinic groups for each group derived from the hydrocarbon source.

The method of preparation of dispersants of this type is basically the same as for the carboxylic dispersants already described. Reagent D-1, in particular, may be prepared by a one-step procedure in which the hydrocarbon source is reacted with maleic anhydride; by a two-step procedure in which the hydrocarbon source is chlorinated and the chlorinated intermediate is reacted with maleic anhydride; or by various combinations of the two procedures.

The following examples illustrate typical methods for the preparation of suitable dispersants of this type.

EXAMPLE 27

A mixture of 1000 parts (0.495 mole) of a polybutene comprising principally isobutene units and having a number average molecular weight of 2020 and a weight average molecular weight of 6049 and 115 parts (1.17 moles) of maleic anhydride is heated to 184° C. over 6 hours as 85 parts (1.2 moles) of chlorine is added beneath the surface. At 184°–189° C. an additional 59 parts (0.83 mole) of chlorine is added over 4 hours. The reaction mixture is stripped by blowing with nitrogen at 186°–190° C. for 26 hours to yield a polybutene-substituted succinic anhydride having a saponification number of 87 as determined by ASTM Procedure D94.

To 893 parts (1.38 equivalents) of this substituted succinic anhydride is added 1067 parts of mineral oil and 57 parts (1.38 equivalents) of a commercial ethylene polyamine mixture containing from about 3 to about 10 nitrogen atoms per molecule. The mixture is heated to 140°–155° C. for 3 hours and is then stripped by blowing with nitrogen. The stripped liquid is filtered and the filtrate is the desired dispersant (approximately 50% solution in oil).

EXAMPLE 28

A mixture of 334 parts (0.52 equivalent) of the polybutenyl succinic anhydride of Example 27, 548 parts of mineral oil, 30 parts (0.88 equivalent) of pentaerythritol and 8.6 parts (0.0057 equivalent) of Polyglycol 112-2 demulsifier from Dow Chemical Company is heated at 150°–210° C. for about 11 hours. The mixture is cooled to 190° C. and 8.5 parts (0.2 equivalent) of the ethylene polyamine mixture of Example 27 is added. The mixture is stripped by blowing with nitrogen for 3 hours at 205° C. and is filtered to yield the desired dispersant as an approximately 40% solution in oil.

Also preferred for use as component D, as an alternative to the carboxylic dispersants hereinabove described, are the Mannich dispersants. These are, as previously noted, reaction products of certain alkyl phenols with aldehydes (usually lower aliphatic aldehydes and especially formaldehyde) and amino compounds. The structure of the alkyl substituent on the phenol is subject to the same preferences as to source, structure, molecular weight and the like expressed hereinabove with respect to the carboxylic dispersant. The amino compounds are the same as those described with reference to nitrogen-bridged carboxylic dispersants and are subject to the same preferences.

Suitable Mannich dispersants for use as component D are illustrated in the working examples of the aforementioned U.S. Pat. No. 3,980,569 and German Application Ser. No. 2,551,256. The following examples are also illustrative.

EXAMPLE 29

A mixture of 3740 parts (2 equivalents) of a polybutenyl phenol in which the polybutene substituent comprises principally isobutene units and has a molecular weight of about 1600, 1250 parts of textile spirits and 2000 parts of isopropyl alcohol is stirred as 352 parts (2.2 equivalents) of 50% aqueous sodium hydroxide is added, followed by 480 parts (6 equivalents) of 38% aqueous formaldehyde solution. The mixture is stirred for 2 hours, allowed to stand for 2 days and then stirred again for 17 hours. Acetic acid, 150 parts (2.5 equivalents), is added and the mixture is stripped of volatile materials under vacuum. The remaining water is removed by adding benzene and distilling azeotropically; during the distillation, 1000 parts of mineral oil is added in two portions. The distillation residue is filtered.

To 430 parts (0.115 equivalent) of the filtrate is added with stirring, at 90° C., 14.1 parts (0.345 equivalent) of the polyethylene amine mixture of Example 3. The mixture is heated at 90°–120° C. for 2 hours and then at 150°–160° C. for 4 hours, with nitrogen blowing to remove volatiles. The resulting solution is filtered to yield the desired Mannich dispersant (52% solution in mineral oil) which contains 1.03% nitrogen.

EXAMPLE 30

A mixture of 564 parts (0.25 equivalent) of polybutenyl phenol in which the polybutene substituent comprises principally isobutene units and has a molecular weight of about 2020, 400 parts of mineral oil and 16.5 parts of isobutyl alcohol is heated to 65° C., with stirring, and 2.15 parts (0.025 equivalent) of 50% aqueous sodium hydroxide solution is added, followed by 16.5 parts (0.5 equivalent) of paraformaldehyde. The mixture is stirred at 80°–88° C. for 6 hours and then 5 parts (0.025 equivalent) of 18.5% aqueous hydrochloric acid is added slowly, with continued stirring, followed by 36 parts (0.875 equivalent) of the polyethylene amine of Example 3, at 88° C. Mixing is continued at 88°–91° C. for 30 minutes. The mixture is then heated to about 158° C. with nitrogen blowing to remove volatiles.

Sulfur, 16 parts (0.5 mole), and 25 parts of a filter aid material are added slowly at 150° C., with stirring, after which the mixture is blown with nitrogen at 150°–155° C. for 3 hours. The mixture is then cooled to 132° C. and filtered to yield the desired sulfurized Mannich product as a 60% solution in mineral oil; it contains about 0.63% sulfur.

COMPONENT E—THE VISCOSITY IMPROVER

The compositions of this invention also preferably contain at least one viscosity improving component; that is, at least one component capable of substantially improving the viscosity properties thereof. For the purposes of this invention, a substance is considered to substantially improve the viscosity properties of a composition if its incorporation in the composition in operative amounts causes an increase in its viscosity index (as determined by ASTM procedure D2270) of at least 6 units.

A number of types of viscosity improvers are known in the art, and many of these are described in Ranney, *Lubricant Additives* (Noyes Data Corporation, 1973), pp. 93–119. Illustrative viscosity improvers include various olefin polymers such as polybutene (especially containing predominantly isobutene units); ethylene-propylene copolymers; copolymers of ethylene and other low molecular weight olefins (especially α-olefins); terpolymers of ethylene; propylene and various dienes (especially non-conjugated dienes); polybutadiene; hydrogenated styrene-butadiene copolymers; alkylated polystyrenes; polymers of alkyl methacrylates; alkylene polyethers; and polyesters prepared from polyols, short-chain dicarboxylic acids and monobasic carboxylic acid terminators (useful predominantly in lubricants in which the lubricating oil is a synthetic ester).

It is also within the scope of this invention to use as component D a composition which improves viscosity properties as well as serving as a dispersant or detergent. Many such compositions are known and reference is made to *Lubricant Additives, op. cit.*, pp. 119–136. When component D also improves viscosity properties, it may be possible to decrease the amount of component E used or to eliminate it entirely.

The present invention contemplates two materials as being particularly useful as combination viscosity improvers and detergents or dispersants. The first comprises the dispersants containing more than one succinic moiety per molecule, preferably those prepared from a hydrocarbon source having a number average molecular weight ($\overline{M}n$) of at least about 1300 and usually about 1300–5000 as determined by gel permeation chromatography. Examples 27 and 28 hereinabove illustrate suitable dispersants of this type which also have viscosity improving properties.

The second type of preferred viscosity improver having dispersent or detergent properties comprises interpolymers being substantially free of titratable acidity and containing carboxylic ester groups in which part of the alcohol moieties have at least 8 aliphatic carbon atoms and another part have no more than 7 aliphatic carbon atoms, and also containing carbonyl-polyamino groups in which the polyamino radical is derived from a compound having one primary or secondary amino group. These polymers are described in U.S. Pat. No. 3,702,300, which is incorporated by reference for such description. Preferred are interpolymers prepared by first copolymerizing styrene with maleic anhydride and subsequently esterifying a portion of the carboxylic acid groups with a mixture of primary alcohols having the numbers of carbon atoms noted above, and neutralizing the remaining carboxylic acid groups with a suitable amine. The working examples of U.S. Pat. No. 3,702,300 illustrate specific suitable polymers as does the following example.

EXAMPLE 31

Styrene, 16.3 parts, and maleic anhydride, 12.9 parts, are dissolved in 270 parts of a 2:1 (by weight) benzene-toluene mixture and polymerized at 86° C. for 8 hours in the presence of benzoyl peroxide as an initiator. Mineral oil, 141 parts, is added and the volatile materials are removed by vacuum distillation to yield a slurry.

To 209 parts of the slurry are added 25.2 parts of toluene, 4.8 parts of n-butyl alcohol, 56.6 parts of a mixture of $C_{12-18}$ primary alcohols, and 10 parts of a mixture of $C_{8-10}$ primary alcohols. Sulfuric acid (96%), 2.3 parts, is added and the mixture is heated at 150°–160° C. for 20 hours as water is removed by distillation. An additional 0.18 part of sulfuric acid and 3 parts of n-butyl alcohol are added and esterification is continued until 95% of the carboxylic acid radicals of the polymer have been esterified.

Aminopropylmorpholine, 3.71 parts (10% excess), is then added and the mixture is again heated at 150°–160° C. under vacuum as volatiles are removed by distillation. The stripped product is mixed with 12 parts of mineral oil and filtered to yield the desired interpolymer solution containing 0.16–0.17% nitrogen.

COMPONENT F—THE PHOSPHORUS ACID SALT

A further preferred component in the compositions of this invention is at least one compound of the formula

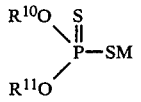

wherein each of $R^{10}$ and $R^{11}$ is a hydrocarbon-based radical having from about 3 to about 20 carbon atoms and M is a Group I metal, a Group II metal, aluminum, tin, iron, cobalt, lead, arsenic, molybdenum, manganese, nickel, or a mixture of any of said metals. Component F, when present, provides load carrying and oxidation inhibiting properties to the lubricant.

Each of $R^{10}$ and $R^{11}$ is preferably an alkyl radical, although it may be an aryl or substituted aryl radical (e.g., phenyl, tolyl, chlorophenyl). Suitable alkyl radicals include propyl, butyl, octyl, decyl, hexadecyl, octadecyl, eicosyl and mixtures thereof. Most often, each of $R^{10}$ and $R^{11}$ is an alkyl radical containing from about 6 to about 20 and preferably from about 6 to about 10 carbon atoms. Branched radicals (e.g., isooctyl, 2-ethylhexyl) are especially preferred.

The metal (M) of the phosphorus acid salt is preferably zinc or molybdenum and especially zinc. As previously noted, it is within the scope of the invention to use salts of more than one metal or to use a mixed salt of two or more metals (e.g., zinc and arsenic, zinc and nickel, molybdenum and manganese).

OTHER COMPONENTS

The compositions of this invention may also contain other additives such as corrosion- and oxidation-inhibiting agents, pour point depressing agents, auxiliary extreme pressure agents and rust inhibitors, color stabilizers, and anti-foam agents.

Auxiliary extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl) disulfide, dibutyl tetrasulfide, sulfurized methyl oleate, sulfurized alkylphenols, sulfurized terpenes, and sulfurized alkyl cyclohexenecarboxylate; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; and metal thiocarbamates, such as zinc dioctyldithiocarbamate and barium heptylphenyl dithiocarbamate.

COMPONENT PROPORTIONS

This invention contemplates the use of the various components described hereinabove in a wide variety of proportions to form useful compositions.

It is possible to add each of the other components in the desired proportions to component A for preparation of a finished lubricant. Preferably, however, one or more of said components are diluted with a substantially inert, normally liquid organic diluent to form an additive concentrate containing a total of from about 20% to about 90% by weight of components other than component A, which may then be diluted with component A to form the finished lubricant. Such concentrates are within the scope of the invention and they may contain, in addition, one or more of the other additives described hereinabove. The preferred diluents for concentrate formation are the same as those described hereinabove for component A, and mineral oil is especially preferred. It is sometimes preferred to formulate component E as a separate concentrate from the one containing the other components.

Typical weight percentages of components B–F are given in Table II. The balance of the composition is component A and, as previously mentioned, is normally mineral oil. It will be apparent from the description hereinabove that component D may comprise both a dispersant and a detergent and when it does, the usual proportions of each are listed in Table II as "Dispersant" and "Detergent", respectively.

TABLE II

| Component | Concentrate | Percent by weight Lubricant | |
|---|---|---|---|
| | | Broad range | Preferred range |
| B | 5–25 | 0.5–3.5 | 1.0–3.5 |
| C | 2–15 | 0.2–1.5 | 0.3–1.0 |
| D | 15–40 | 1.5–4.0 | 1.8–3.3 |
| E | 20–70 | 3–20 | 5.0–15.0 |
| F | 5–30 | 0.5–3.0 | 1.0–2.5 |
| Dispersant | 12–25 | 1.2–2.5 | 1.5–2.5 |
| Detergent | 3–15 | 0.3–1.5 | 0.3–0.8 |

CONCENTRATE AND LUBRICANT EXAMPLES

Typical concentrates and lubricants contemplated in this invention are listed in Tables III and IV. All amounts except those for mineral oil are exclusive of mineral oil used as diluent.

TABLE III

| Ingredient | Parts by weight | | | | |
|---|---|---|---|---|---|
| | Lubricant A | Lubricant B | Lubricant C | D Concentrate | D Lubricant |
| Mineral oil (100 neutral) | — | 98.0 | — | — | — |
| Mineral oil (200 neutral) | — | — | — | — | 90.0 |
| Mineral oil (200 neutral - 45% by volume; 100 neutral - 55% by volume) | 98.0 | — | 82.34 | — | — |
| Diluent mineral oil | — | — | 7.18 | 60.0 | 6.0 |
| Product of Example 1 | 1.0 | 1.5 | 1.99 | 15.0 | 1.5 |
| Product of Example 2 | 1.0 | 0.5 | 0.41 | 5.0 | 0.5 |
| Product of Example 13 | — | — | 2.72 | — | — |
| Product of Example 27 | — | — | — | 20.0 | 2.0 |
| Product of Example 31 | — | — | 1.86 | — | — |
| Basic calcium alkylphenol sulfide | — | — | 0.72 | — | — |
| Reaction product of 2,5-dimercapto-1,3,4-thiadiazole with product of Example 13 | — | — | 1.10 | — | — |
| Hydroxypropyl ester of tetrapropenylsuccinic acid | — | — | 0.35 | — | — |
| Ethoxylated alkylphenol | — | — | 0.24 | — | — |
| Zinc dialkylphosphorodithioate containing $C_{3-6}$ branched chain alkyl groups | — | — | 0.43 | — | — |
| Sulfurized alkyl cyclohexenecarboxylate | — | — | 0.66 | — | — |
| Silicone anti-foam agent | — | — | 0.005 | 0.05 | 0.005 |

TABLE IV

| Ingredient | Parts by weight | | | | | | | |
|---|---|---|---|---|---|---|---|---|
| | E | | F | | G | | H | |
| | Concentrate | Lubricant | Concentrate | Lubricant | Concentrate | Lubricant | Concentrate | Lubricant |
| Mineral oil (100 neutral) | — | balance | — | — | — | — | — | — |
| Mineral oil (200 neutral) | — | — | — | — | — | 91.19 | — | 89.19 |
| Mineral oil (210 neutral - 65% by volume; 110 neutral - 35% by volume) | — | — | — | 89.41 | — | — | — | — |
| Diluent mineral oil | 36.33 | 3.20 | 36.33 | 3.20 | 30.89 | 2.72 | 25.41 | 2.24 |

TABLE IV-continued

| Ingredient | Parts by weight | | | | | | | |
|---|---|---|---|---|---|---|---|---|
| | E | | F | | G | | H | |
| | Concentrate | Lubricant | Concentrate | Lubricant | Concentrate | Lubricant | Concentrate | Lubricant |
| Product of Ex. 1 | 12.61 | 3.11[1] | 12.61 | 1.11 | 26.06 | 2.30 | 12.61 | 3.11[1] |
| Product of Ex. 2 | 4.74 | 0.42 | 4.74 | 0.42 | 4.06 | 0.36 | 4.74 | 0.42 |
| Product of Ex. 27 | 23.43 | 2.06 | 23.43 | 2.06 | 19.67 | 1.73 | — | — |
| Product of Ex. 28 | — | — | — | — | — | — | 23.43 | 2.06 |
| Product of Ex. 31 | — | 2 | — | 1.79 | — | — | — | — |
| Carbonated basic calcium petroleum sulfonate | 6.02 | 0.53 | 6.02 | 0.53 | 5.00 | 0.44 | 6.02 | 0.53 |
| Poly-(1-octene) viscosity improver | — | 3 | — | — | — | — | — | — |
| Zinc dialkylphosphorodithioate containing $C_{6-10}$ branched chain alkyl groups | 16.87 | 1.48 | 16.87 | 1.48 | 14.32 | 1.26 | — | — |
| Zinc dialkylphosphorodithioate containing $C_{14-18}$ straight chain alkyl groups | — | — | — | — | — | — | 27.79 | 2.45 |
| Silicone antifoam agent | 0.057 | 0.005 | 0.057 | 0.005 | 0.097 | 0.0085 | 0.057 | 0.005 |

[1]2.0% added separately from concentrate.
[2]7.0% by volume.
[3]10.0% by volume.

The fuel consumption of engines lubricated with compositions of this invention is measurably lower than that of engines lubricated with previously known lubricants. This can be shown by the Pinto Friction Horsepower Test, in which a Ford Pinto engine is driven by a dynamometer at constant temperature as engine rpm. and torque are measured by a digital tachometer and a precision dial manometer, respectively. Friction horsepower, as calculated from these values, is roughly proportional to fuel consumed and thus decreases with improved fuel economy.

What is claimed is:

1. A lubricating composition comprising:

(A) A major amount of a lubricating oil; and minor effective amounts of (B) a composition prepared by sulfurizing, at a temperature of about 100° to about 250° C., a mixture comprising (B-1) 100 parts by weight of at least one ester of a substantially aliphatic caboxylic acid containing from about 8 to about 30 carbon atoms and a substantially aliphatic alcohol, (B-2) from about 2 to about 50 parts of at least one substantially aliphatic carboxylic acid containing from about 8 to about 30 carbon atoms, and (B-3) from about 25 to about 400 parts by weight of at least one substantially aliphatic monoolefin containing from about 8 to about 36 carbon atoms; and (C) at least one oil-dispersible basic alkali metal sulfonate prepared by intimately contacting for a period of time sufficient to form a stable dispersion, at a temperature between the solidification temperature of the reaction mixture and its decomposition temperature;

(C-1) at least one acidic gaseous material selected from the group consisting of carbon dioxide, hydrogen sulfide, sulfur dioxide, and mixtures thereof, with (C-2) a reaction mixture comprising (C-2-a) at least one oil-soluble sulfonic acid, or derivative thereof susceptible to overbasing;

(C-2-b) at least one alkali metal or basic alkali metal compound;

(C-2-c) at least one lower aliphatic alcohol; and (C-2-d) at least one oil-soluble carboxylic acid or functional derivative thereof.

2. A composition according to claim 1 wherein reagent B-1 is at least one fatty acid ester of a polyhydric alcohol, reagent B-2 is at least one fatty acid, and reagent B-3 is at least one aliphatic α-olefin.

3. A composition according to claim 2 wherein the sulfurizing agent is sulfur.

4. A composition according to claim 3 wherein reagent B-1 is at least one fatty oil.

5. A composition according to claim 4 wherein reagent B-1 is an ester the acidic moieties of which contain olefinic unsaturation.

6. A composition according to claim 5 wherein reagent B-2 is at least one unsaturated fatty acid.

7. A composition according to claim 6 wherein reagent B-2 is tall oil acid and is present in the amount of about 2–8 parts by weight.

8. A composition according to claim 7 wherein reagent B-3 is at least one $C_{12-20}$ α-olefin.

9. A composition according to claim 8 wherein reagent B-3 is a commercial mixture of α-olefins and is present in the amount of from about 25 to about 75 parts by weight.

10. A composition according to claim 9 wherein reagent B-1 is soybean oil.

11. A composition according to claim 1 wherein reagent C-1 is carbon dioxide.

12. A composition according to claim 11 wherein reagent C-2-b is at least one basic sodium compound.

13. A composition according to claim 12 wherein reagent C-2-a is at least one alkylated benzenesulfonic acid.

14. A composition according to claim 13 wherein reagent C-2-c is methanol, ethanol or propanol.

15. A composition according to claim 14 wherein reagent C-2-c is methanol.

16. A composition according to claim 15 wherein reagent C-2-d is a substituted succinic acid having the formula

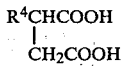

or an anhydride thereof, wherein $R^4$ is a saturated or substantially saturated aliphatic radical having from about 8 to about 700 carbon atoms.

17. A composition according to claim 16 wherein $R^4$ is polybutenyl radical containing predominantly isobutene units.

18. A composition according to claim 17 wherein $R^4$ has a number average molecular weight from about 700 to about 5000.

19. A composition according to claim 1 which additionally contains (D) at least one oil-dispersible detergent or dispersant, with the proviso that if it is a detergent it is not a basic alkali metal salt.

20. A composition according to claim 19 wherein the detergent is a basic alkaline earth metal salt or complex of a phenol, sulfonic acid, carboxylic acid or phosphorus acid.

21. A composition according to claim 20 wherein the detergent is a basic calcium sulfonate.

22. A composition according to claim 19 wherein the dispersant is characterized by the presence of an oil-solubilizing group containing at least about 40 aliphatic carbon atoms bonded directly to a polar group.

23. A composition according to claim 22 wherein the dispersant is a carboxylic dispersant, a Mannich dispersant, an amine dispersant, a polymeric dispersant, or a post-treatment product of any of the foregoing.

24. A composition according to claim 23 wherein the dispersant is a carboxylic dispersant characterized by the presence within its molecular structure of an acyl, acyloxy or acylimidoyl radical containing at least about 44 carbon atoms and a radical in which a nitrogen or oxygen atom is attached directly to said acyl, acyloxy or acylimidoyl radical, said nitrogen or oxygen atom also being attached to a hydrocarbon-based radical.

25. A composition according to claim 24 wherein the dispersant is prepared by reaction of a substantially saturated hydrocarbon-substituted or halohydrocarbon-substituted succinic acid-producing compound with at least one of an alcohol and an alkylene polyamine.

26. A composition according to claim 25 wherein the substituent on the succinic acid-producing compound contains at least about 50 aliphatic carbon atoms and the dispersant is prepared by the reaction of said succinic acid-producing compound with at least one alcohol.

27. A composition according to claim 26 wherein the alcohol is pentaerythritol.

28. A composition according to claim 27 wherein the substituent on the succinic acid-producing compound contains at least about 50 aliphatic carbon atoms and the dispersant is prepared by the reaction of said succinic acid-producing compound with at least one alkylene polyamine.

29. A composition according to claim 28 wherein the alkylene polyamine is an ethylene polyamine.

30. A composition according to claim 23 wherein the dispersant is a Mannich dispersant comprising the reaction product of an alkyl phenol in which the alkyl group contains at least about 40 carbon atoms with an aliphatic aldehyde containing at least about 7 carbon atoms and an amine.

31. A composition according to claim 30 wherein the aldehyde is formaldehyde and the amine is an alkylene polyamine.

32. A composition according to claim 31 wherein the amine is an ethylene polyamine.

33. A composition according to claim 22 wherein the dispersant also improves the viscosity properties of the lubricant.

34. A composition according to claim 19 which additionally contains (E) at least one component capable of substantially improving the viscosity properties thereof.

35. A composition according to claim 19 which additionally contains (F) at least one compound of the formula

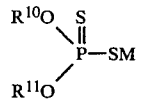

wherein each of $R^{10}$ and $R^{11}$ is a hydrocarbon-based radical containing from about 3 to about 20 carbon atoms and M is a Group I metal, a Group II metal, aluminum, tin, iron, cobalt, lead, arsenic, molybdenum, manganese, nickel, or a mixture of two or more of said metals.

36. A composition according to claim 35 wherein each of $R^{10}$ and $R^{11}$ is an alkyl radical containing from about 6 to about 20 carbon atoms.

37. A composition according to claim 36 wherein M is zinc or molybdenum.

38. A composition according to claim 37 wherein M is zinc.

39. An additive concentrate comprising a substantially neutral, normally liquid organic diluent and, dissolved or stably dispersed therein:

(B) A composition prepared by sulfurizing, at a temperature of about 100° to about 250° C., a mixture comprising (B-1) 100 parts by weight of at least one ester of a substantially aliphatic carboxylic acid containing from about 8 to about 30 carbon atoms and a substantially aliphatic alcohol, (B-2) from about 2 to about 50 parts of at least one substantially aliphatic carboxylic acid containing from about 8 to about 30 carbon atoms, and (B-3) from about 25 to about 400 parts by weight of at least one substantially aliphatic monoolefin containing from about 8 to about 36 carbon atoms; and (C) at least one oil-dispersible basic alkali metal sulfonate prepared by intimately contacting for a period of time sufficient to form a stable dispersion, at a temperature between the solidification temperature of the reaction mixture and its decomposition temperature;

(C-1) at least one acidic gaseous material selected from the group consisting of carbon dioxide, hydrogen sulfide, sulfur dioxide, and mixtures thereof, with (C-2) a reaction mixture comprising (C-2-a) at least one oil-soluble sulfonic acid, or derivative thereof susceptible to overbasing;

(C-2-b) at least one alkali metal or basic alkali metal compound;

(C-2-c) at least one lower aliphatic alcohol; and (C-2-d) at least one oil-soluble carboxylic acid or functional derivative thereof.

40. A concentrate according to claim 39 wherein reagent B-1 is at least one fatty oil, reagent B-2 is tall oil acid and is present in the amount of about 2–8 parts by weight, reagent B-3 is at least one $C_{12-20}$ α-olefin, and the sulfurizing agent is sulfur.

41. A concentrate according to claim 40 wherein reagent B-1 is soybean oil and reagent B-3 is a commercial mixture of α-olefins and is present in the amount of from about 25 to about 75 parts by weight.

42. A concentrate according to claim 39 wherein reagent C-1 is carbon dioxide; reagent C-2-a is at least one alkylated benzenesulfonic acid; reagent C-2-b is at least one basic sodium compound; reagent C-2-c is methanol, ethanol or propanol; and reagent C-2-d is a substituted succinic acid having the formula

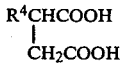

or an anhydride thereof, wherein $R^4$ is a saturated or substantially saturated aliphatic radical having from about 8 to about 700 carbon atoms.

43. A concentrate according to claim 42 wherein $R^4$ is a polybutenyl radical containing predominantly isobutene units and has a number average molecular weight from about 700 to about 5000.

44. A concentrate according to claim 39 which additionally contains (D) at least one oil-dispersible detergent or dispersant, with the proviso that if it is a detergent it is not a basic alkali metal salt.

45. A concentrate according to claim 44 wherein the detergent is a basic calcium sulfonate.

46. A concentrate according to claim 44 wherein the dispersant is a carboxylic dispersant characterized by the presence within its molecular structure of an acyl, acyloxy or acylimidoyl radical containing at least about 44 carbon atoms and a radical in which a nitrogen or oxygen atom is attached directly to said acyl, acyloxy or acylimidoyl radical, said nitrogen or oxygen atom also being attached to a hydrocarbon-based radical.

47. A concentrate according to claim 46 wherein the dispersant is prepared by reaction of a substantially saturated hydrocarbon-substituted or halohydrocarbon-substituted succinic acid-producing compound containing at least about 54 aliphatic carbon atoms with at least one ethylene polyamine.

48. A concentrate according to claim 44 wherein the dispersant is a Mannich dispersant comprising the reaction product of an alkyl phenol in which the alkyl group contains at least about 40 carbon atoms with an aliphatic aldehyde containing at least about 7 carbon atoms and an amine.

49. A concentrate according to claim 48 wherein the aldehyde is formaldehyde and the amine is an ethylene polyamine.

50. A concentrate according to claim 44 which additionally contains (F) at least one compound of the formula

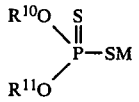

wherein each of $R^{10}$ and $R^{11}$ is a hydrocarbon-based radical containing from about 3 to about 20 carbon atoms and M is a Group I metal, A Group II metal, aluminum, tin, iron, cobalt, lead, arsenic, molybdenum, manganese, nickel, or a mixture of two or more of said metals.

51. A concentrate according to claim 50 wherein each of $R^{10}$ and $R^{11}$ is an alkyl radical containing from about 6 to about 20 carbon atoms and M is zinc.

52. A method of reducing fuel consumption in an internal combustion engine which comprises lubricating said engine during operation with a lubricant comprising a composition according to any of claims 1–10 and 11 to 38.

* * * * *

UNITED STATES PATENT AND TRADEMARK OFFICE

CERTIFICATE OF CORRECTION

PATENT NO. : 4,326,972

DATED : April 27, 1982

INVENTOR(S) : WILLIAM B. CHAMBERLIN, III

It is certified that error appears in the above—identified patent and that said Letters Patent is hereby corrected as shown below:

In Column 33, Line 13: insert --a-- after "is"

In Column 33, Line 57: change "claim 27" to read --claim 25--

Signed and Sealed this

*Nineteenth* Day of *October 1982*

[SEAL]

*Attest:*

GERALD J. MOSSINGHOFF

*Attesting Officer*

*Commissioner of Patents and Trademarks*